US008707969B2

(12) United States Patent
Seng et al.

(10) Patent No.: US 8,707,969 B2
(45) Date of Patent: Apr. 29, 2014

(54) AUTOMATED HAIR CARE PROCESS

(75) Inventors: Juergen Seng, Kelkheim (DE); Olaf Soerensen, Mainz (DE); Christoph Schmitz, Langgoens (DE); Francis Pinto, Oberursel (DE); Markus Schuessler, Koenigstein (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 13/296,299

(22) Filed: Nov. 15, 2011

(65) Prior Publication Data

US 2012/0055501 A1 Mar. 8, 2012

Related U.S. Application Data

(63) Continuation of application No. PCT/IB2010/053131, filed on Jul. 8, 2010.

(30) Foreign Application Priority Data

Jul. 10, 2009 (EP) ..... 09009006

(51) Int. Cl.

| | |
|---|---|
| ***A45D 1/00*** | (2006.01) |
| ***A45D 2/40*** | (2006.01) |
| ***A45D 1/04*** | (2006.01) |
| ***A45D 2/36*** | (2006.01) |
| ***A45D 4/00*** | (2006.01) |
| ***A45D 7/02*** | (2006.01) |
| ***A45D 20/08*** | (2006.01) |
| ***A45D 4/06*** | (2006.01) |
| ***A45D 4/12*** | (2006.01) |
| ***A45D 20/12*** | (2006.01) |
| ***A45D 20/10*** | (2006.01) |
| ***H05B 3/42*** | (2006.01) |

(52) U.S. Cl.

USPC ..... 132/211; 132/224; 132/229; 132/269; 132/212; 132/271; 219/222; 219/225; 219/229; 34/96; 392/383; 392/384; 392/385

(58) Field of Classification Search

USPC ..... 132/224, 269, 271, 210, 211, 212, 227, 132/229, 230, 231, 240, 241, 243, 200; 219/222, 223, 225, 228, 229; 34/96, 34/283, 550, 553; 392/379, 380, 383–385; 165/230, 247, 253, 288, 289, 287; 236/44 C; 607/6, 102, 110, 108, 109

See application file for complete search history.

(56) References Cited

U.S. PATENT DOCUMENTS 3,658,071 A * 4/1972 Wise ..... 132/233
4,167,820 A * 9/1979 de Groot ..... 34/554

(Continued)

FOREIGN PATENT DOCUMENTS

DE 3112384 A1 11/1982
EP 0679350 A1 11/1995

(Continued)

OTHER PUBLICATIONS

International Search Report dated Feb. 9, 2011, 6 pgs.

*Primary Examiner* — Vanitha Elgart
(74) *Attorney, Agent, or Firm* — Jeffrey V Bamber; Jerry J Yetter

(57) ABSTRACT

A hair treatment device and a corresponding method for treating hair are disclosed. The hair treatment device is suitable for heating hair and has a heating element that is heated to a starting temperature and whose temperature is regulated by a temperature control. The hair treatment device has a sensor that measures data from which a parameter based on the condition of the hair can be generated, wherein the parameter influences the temperature control.

16 Claims, 4 Drawing Sheets

(56) References Cited

U.S. PATENT DOCUMENTS

| | | | | | |
|---|---|---|---|---|---|
| 4,292,985 | A | * | 10/1981 | Itogawa et al. | 132/272 |
| 4,424,437 | A | * | 1/1984 | Walter et al. | 392/383 |
| 4,541,442 | A | * | 9/1985 | Hollmann et al. | 132/212 |
| 4,602,143 | A | | 7/1986 | Mack et al. | |
| 4,744,154 | A | | 5/1988 | Bollinger et al. | |
| 4,877,042 | A | * | 10/1989 | Downey | 132/212 |
| 4,914,273 | A | * | 4/1990 | Matsui | 219/222 |
| 5,063,688 | A | * | 11/1991 | Moll et al. | 34/97 |
| 5,365,953 | A | * | 11/1994 | Feughelman | 132/231 |
| 5,560,121 | A | * | 10/1996 | Fertig et al. | 34/90 |
| 5,636,318 | A | * | 6/1997 | Polaert et al. | 392/380 |
| 5,785,064 | A | * | 7/1998 | Simpson | 132/226 |
| 5,857,379 | A | * | 1/1999 | Lulofs et al. | 73/73 |
| 6,026,821 | A | | 2/2000 | Last | |
| 6,718,651 | B2 | * | 4/2004 | Perez et al. | 34/96 |
| 7,356,943 | B2 | * | 4/2008 | Behbehani | 34/97 |
| 7,586,066 | B2 | * | 9/2009 | Bell | 219/678 |
| 7,913,416 | B1 | * | 3/2011 | Scieri | 34/97 |
| 8,480,724 | B2 | * | 7/2013 | Bly | 607/107 |
| 2004/0103553 | A1 | * | 6/2004 | Kroll et al. | 34/96 |
| 2004/0169969 | A1 | * | 9/2004 | Takeda | 361/42 |
| 2007/0056960 | A1 | * | 3/2007 | Bell | 219/678 |
| 2008/0077044 | A1 | * | 3/2008 | Nakayama et al. | 600/549 |
| 2009/0044823 | A1 | * | 2/2009 | Overend et al. | 132/211 |
| 2009/0288676 | A1 | * | 11/2009 | Shim | 132/269 |
| 2011/0245735 | A1 | * | 10/2011 | Eckhouse et al. | 601/3 |
| 2012/0186599 | A1 | * | 7/2012 | Schmid | 132/210 |

FOREIGN PATENT DOCUMENTS

| | | | |
|---|---|---|---|
| EP | 1400187 | A1 | 3/2004 |
| GB | 2147204 | A | 5/1985 |
| GB | 2432310 | A1 | 5/2007 |
| JP | 3147636 | U | 1/2009 |

* cited by examiner

AUTOMATED HAIR CARE PROCESS

CROSS REFERENCE TO RELATED APPLICATIONS

This application is a continuation of prior co-pending International Application No. IB2010/053131 filed Jul. 8, 2010, designating the United States.

FIELD OF THE INVENTION

This invention relates to a hair treatment device and a corresponding method for treating hair. Considered here as hair treatment devices are in particular hair dryers, curling irons and hair straighteners. The invention can be used both at home and in hair salons. The invention relates in particular to a temperature control for hair treatment devices and a related method.

BACKGROUND OF THE INVENTION

The application GB 2 147 204 A (applicant: J. H. Downey) discloses a hair comb that has a moisture sensor. This comb is designed to optically indicate the hair's level of dryness. It can therefore be used together with a hair dryer, for example. For example, a user can hold the comb in one hand and the hair dryer in the other hand and, based on the data display on the comb, direct the flow of warm air to parts of the hair that are still wet.

The patent application GB 2 432 310 A1 (Jemella Ltd.) discloses a flat iron having a temperature gauge and a switching circuit, which elements are designed to ensure that the flat iron can be switched on only after a certain minimum temperature has been reached. According to this disclosure, suitable minimum temperatures are between roughly 0° C. and 10° C. As the application describes, switching on the device at temperatures beneath a certain threshold can be disadvantageous, in particular because the flat iron can then be damaged by any condensation that is formed.

The European patent specification EP 0 176 003 B1 (Wella A G) discloses a method for measuring and regulating the amount of moisture in the hair that can be used with hair drying hoods. Hair drying hoods like the ones typically used in hair salons are generally equipped with a return air duct. A humidity sensor can then be installed in this return air duct. This sensor in turn is designed to generate a signal to switch off the drying program.

The European patent application EP 1 400 187 A1 (Cho) discloses a switching circuit by means of which the temperature of a flat iron can be kept constant. This exemplary switching circuit is, like many other switching circuits, designed to receive measurement data from a temperature sensor and, to the extent possible, to keep the flat iron at a constant, preset temperature. The temperature sensor is thus not used to vary the temperature but rather to keep the once-preset temperature constant.

Thus, the prior art has several disadvantages and limitations. In particular, despite various attempts at temperature regulation and process control, no way has been found to automatically and conveniently control the temperature.

The problem of the present invention is to provide a hair treatment device and a corresponding method by which hair properties can be measured and temperature control can be used in the hair treatment device.

This problem is solved by a hair treatment device according to claim 1 and a method for treating hair according to claim 11.

DESCRIPTION

Figure 1:
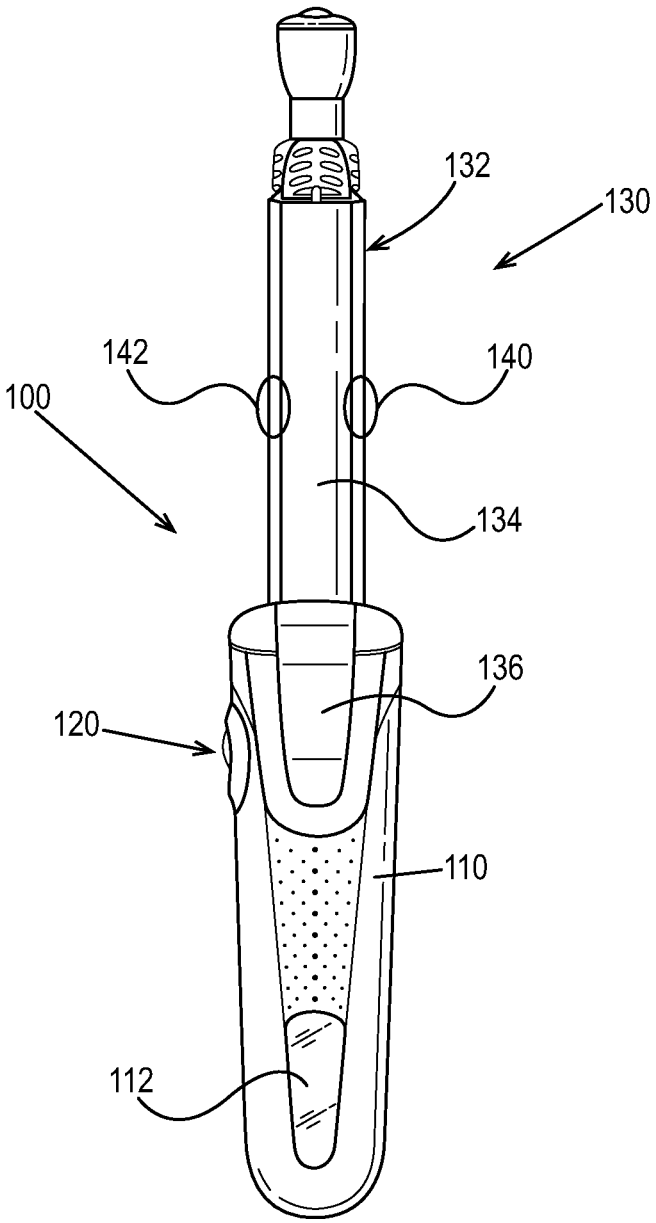
FIG. 1 shows a curling iron.

The invention relates to a hair treatment device and a corresponding method for treating hair. The invention relates to a hair treatment device that is suitable for heating hair and which has a heating element that is heated to a starting temperature and whose temperature is regulated by a temperature control, wherein the hair treatment device has a sensor that measures data from which a parameter based on the condition of the hair can be generated, wherein the parameter influences the temperature control.

Thus, the present invention relates to a hair treatment device in general, which device could be a hair treatment device for professional use; i.e., one that is generally used in a hair salon. These devices are also, in particular, hair drying hoods. The hair treatment device may also be one of the typical devices for use at home, for example hair dryers, hot-air brushes, curling irons and flat irons. All of these devices have at least one heating element that is executed in various forms, depending on the device. In the case of hair dryers and drying hoods, there is generally an air heater that typically consists of an arrangement of heated wires. Most other devices also use resistance heaters, for example in the form of hot plates in the case of a flat iron. In some case a non-electric heater is also provided, for example in the case of gas-powered devices.

When the device is switched on, this heating element is heated to a starting temperature. In some cases the device is already used before said temperature is reached. However, the starting temperature is preset when the device is switched on. For example, there can be a simple power switch, in which it is not possible to choose another temperature. In addition to the power switch, there may also be a control unit by means of which a starting temperature can be chosen.

The temperature of the heating element of the hair treatment device now becomes regulated by a temperature control. This temperature control may already regulate the starting temperature or the control may become active as soon as the starting temperature is reached; it also acts to regulate any changes in temperature. However, switching off the device is not the task of the temperature control. But alternatively or in addition, it is also possible, in particular in the case of flat irons and curling irons, that the temperature control can also turn off the device, which in the process also temporarily or permanently switches off the heating element.

According to the invention, the hair treatment device has within it a sensor that measures data from which a parameter based on the condition of the hair can be generated. For example, the sensor can be installed in the hair treatment device. However, alternatively or in addition, it is also possible that the sensor is part of an attachment to the hair treatment device. For example, one such attachment could be a slip-on nozzle for a hair dryer. Alternatively or in addition, it is also possible that the sensor is provided as part of a separate component that is essentially only used to gather data.

Said sensor can measure various relevant data from which a parameter based on the condition of the hair can be generated. Such data are, for example, the temperature, consistency or moisture of the hair. These data may be measured directly on the hair, but they also can be measured indirectly. For example, the temperature of the hair affects the temperature of a component placed on the hair, like the temperature, for example, of a heating element in contact with the hair. Other useful data may also be generated by measuring the tensile force with which hair is drawn over at least one surface. The measurement can be taken using a single surface or by means of several, in particular two, surfaces, in which case the two surfaces are pressed against each other. The two heating surfaces of a hair straightener or the heating surface and the clamping surface of a curling iron are also possible.

From this data a parameter based on the condition of the hair can be generated. This can be a simple parameter chosen from two values or a parameter chosen from a predetermined number of values or even a parameter chosen from a continuum of numerical values. According to the invention, this parameter is now supposed to influence the temperature control, which influence may simply be in the form of increasing or lowering the temperature. It is also possible that the parameter varies the temperature along a specific temperature curve.

It has proven to be especially advantageous if the sensor sorts temperature data for the hair treatment device. In particular, it is possible to provide a hair treatment device having two sensors that can generate a parameter that is a temperature difference based on the condition of the hair. For example, the treatment temperature can be raised when the difference in temperature is significant or can be lowered when it is negligible.

It has been shown that the use of sensors as a temperature control according to the invention is especially advantageous in the case of hair straighteners or so-called "flat irons." Such devices typically have two arms that can be folded out and together and between which hair can be fed through. Generally, at least one arm has a heating surface; frequently both arms have a heating surface. The opposite arm may have a contact surface with which the hair can be pressed onto the heating surface. However, the configuration of the hair straightener is often symmetrical; i.e., there are two opposite heating surfaces that also act as contact surfaces for the other heating surface. Hair is guided through the hair straightener in a feed-through direction. At the same time, the hair is first guided to a front section of a first heating surface and then to a rear section of a heating surface, i.e. to an area in the feed-through direction behind the front section. According to the invention, a first sensor can now be provided in the front section and a second sensor can be provided in the rear section. The latter sensor then measures each temperature on the heating surface, which can lead to differences in temperature that are also based on the type and the condition of the hair being guided through the device.

In another aspect, the present invention also relates to a method for thermal hair treatment that automatically regulates the treatment temperature based on the condition of the hair. Such a method may be, in particular, one in which a hair straightener is used as a hair treatment device where the first contact of the hair treatment device with the hair takes place at a preset temperature. This preset temperature can then be changed, depending on the temperature difference measured between the first and the second sensor. In particular, it is possible that the preset temperature is increased when a significant difference in temperature is measured between the two sensors. On the other hand, the preset temperature is lowered when a negligible difference in temperature is measured between the two sensors.

The invention can be used as a hair treatment device with a curling iron. FIG. 1 depicts a suitable curling iron that has a handle 110 equipped with a see-through window 112. This see-through window 112 makes it possible to see the level of the gas cartridge. Thus, the present invention can also be used with non-electric devices, namely for example with gas-powered devices that generate heat output by, for example, catalytic gas combustion. The device has a temperature control such as a switch 120 that serves as an on-off switch. In principle, it is also conceivable for the switch to allow more than one starting temperature to be preset. The device also has a hair treatment unit 130 that comprises a cylinder bar 132 and a clamp 134. By means of the control lever 136, the clamp 134 can be dislodged from the cylinder bar 132 and the hair to be straightened can be inserted between cylinder bar 132 and clamp 134. It is possible to attach at least one sensor or even two sensors to various places on the curling iron 100. It is particularly advantageous to use the area 140 to attach a first sensor and, alternatively or in addition, to use the area 142 to attach a second sensor. The sensors then lie to the left and to the right of the clamp 134. As a consequence, they are in contact with hair that is guided straight to the curling iron and also with hair that leaves the area of the curling iron.

Figure 2:
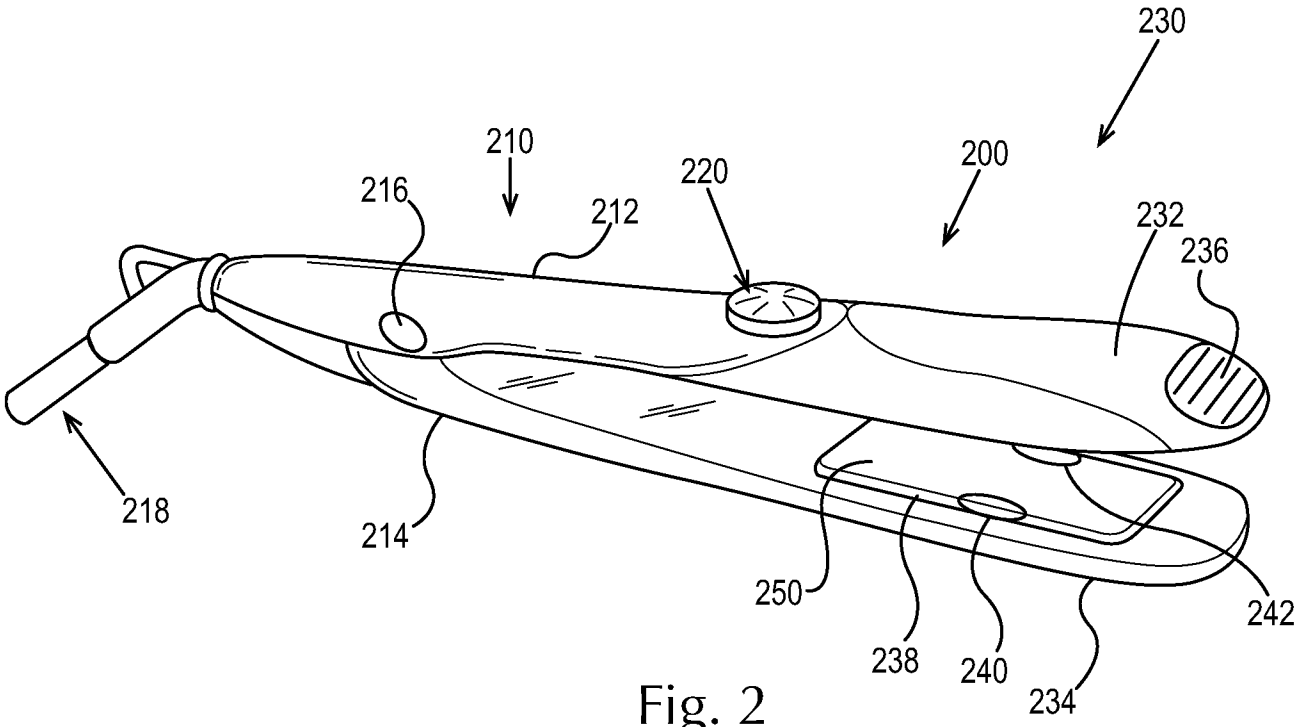
FIG. 2 shows a perspective view of a hair straightener.

FIG. 2 shows a hair straightener that represents another hair treatment device according to the invention. The hair straightener 200 has a handle or grip area 210 and a hair treatment section 230. The grip area comprises a first grip area 212 and a second grip area 214, both of which are part of the arms of the hair straightener 200. A connecting joint 216 links the two arms. A power cable 218 is provided at the end of the hair straightener 200. Thus, this is an electrically powered hair treatment device. A temperature control 220 is also provided. In the form of the dial shown, it is easy to pre-select a desired starting temperature. The temperature control 220 may also act as an "on" switch. Alternatively, the device can be turned on and off by, for example, connecting the cable 218 to the network and by removing the cable from the power supply. The hair treatment section 230 comprises the hair treatment section of the first arm 232 and the hair treatment section of the second arm 234. Visible on the first arm 232 is a grip area 236. A similar and opposite grip area can also be provided on the hair-treatment end of the second arm 234. Visible in the hair treatment section of the second arm 234 is a heating element 238. A corresponding heating element can also be provided in the hair treatment section of the first arm 232. Alternatively, an unheated contact plate can be provided there.

The heating element 238 can be equipped with one, two or more sensors. It is advantageous to provide a sensor in the area 240 and another sensor in the area 242. The sensors can then measure the temperature of hair that in the feed-through direction first passes the area 240 and then passes the area 242.

Figure 3:
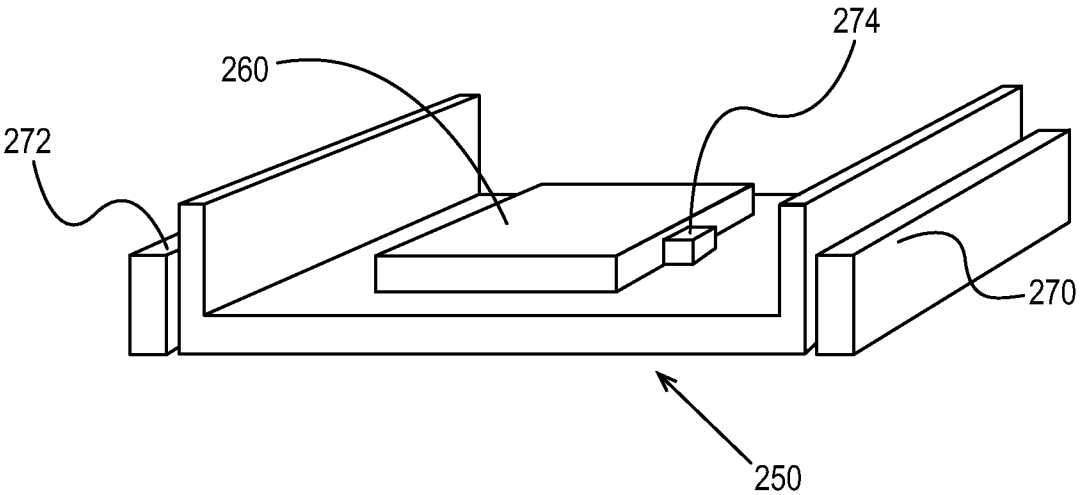
FIG. 3 shows a schematic sectional view through a hair straightener.

FIG. 3 shows a schematic view of a lateral cut through a heating element like the one that can be used, for example, as a first heating element 238 in the hair straightener 200. There is a visible cut in the transverse direction in which the heating surface 250 faces downwards. The heating surface 250 is part of a generally U-shaped metallic heating element. A heating element 260 is provided on the back of the heating element, opposite the heating surface 250. The heating element 260 is basically heated by resistive heat. It passes its heat on to the heating element and the heating surface 250. Provided on the side of the heating element, specifically on the first of the U-shaped legs, is a first sensor 270. In this case, when the heating element is installed properly in a hair straightener, the first sensor is situated in the area 240. Provided on the opposite, other side leg of the U-shape is a second sensor 272. In this case, the second sensor corresponds to the area 242. Additional sensors can be provided, both in area 240 and in area 242. When the heating surface 250 comes into contact with hair, the first sensor 270 can measure a temperature that is characteristic for hair fed into the hair straightener and the second sensor 272 can measure a value that is characteristic for hair that leaves the hair straightener. In addition, in this case a third sensor 274 is provided that is situated directly adjacent to the heating element 260. The third sensor makes it possible to define a temperature curve even more precisely. In particular, the third sensor can also help keep the temperature of the heating element at a specific and constant value, provided said value doesn't change.

Figure 4:
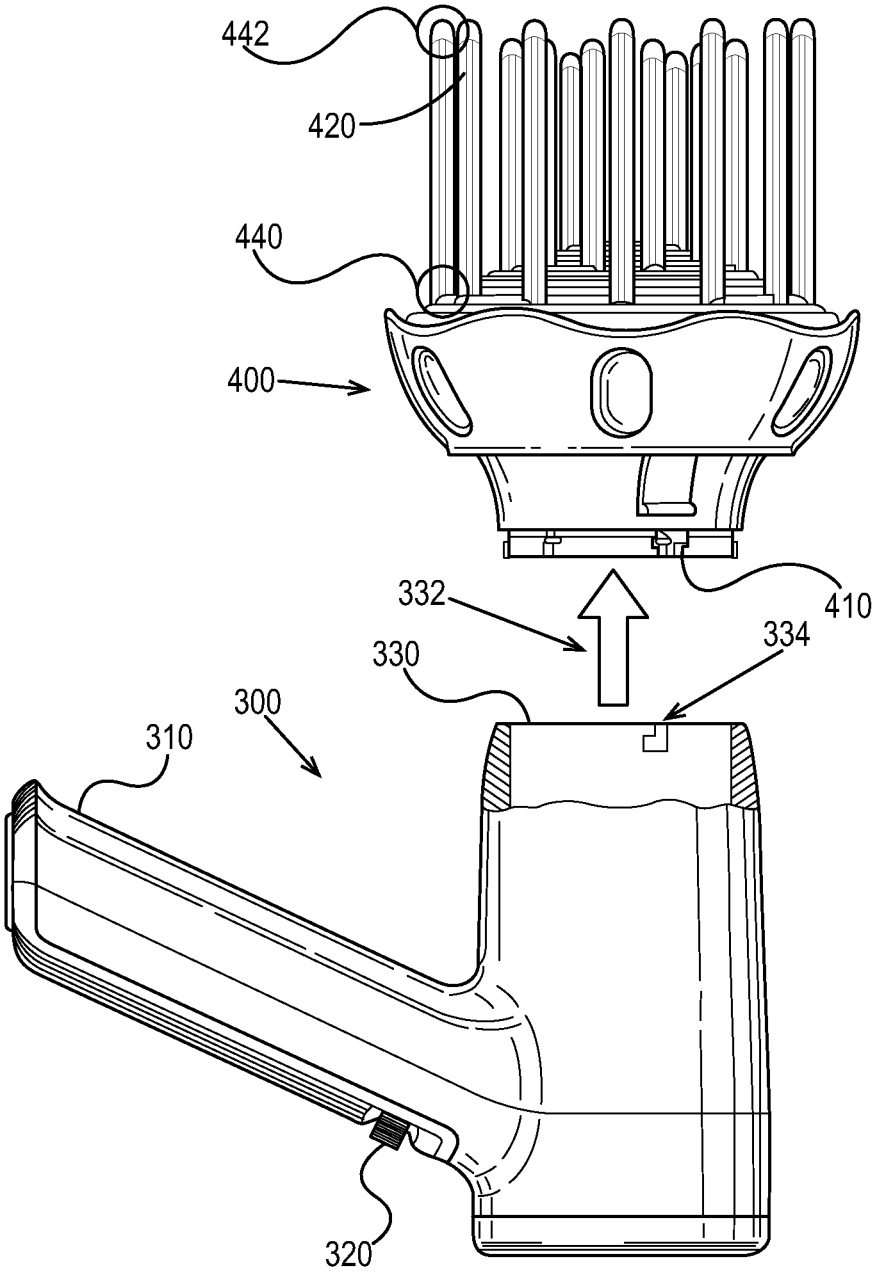
FIG. 4 shows a hair dryer with attachment.

In FIG. 4 shows a perspective view of a hair dryer 300. One distinguishing element is its handle 310, which contains the "on" switch 320. The "on" switch serves to bring the flow of air to a fixed temperature, but frequently there are also two or three temperature levels that can be selected by a switch. Essentially the hot-air outlet nozzle can be viewed as a hair-treatment part 330 of the hair dryer 300 that blows out hot air in the outlet direction 332. The hair-treatment part 330 also contains the connecting element 334 that is executed in the shape of a groove-like depression. This connecting element 334 facilitates the connection to the attachment 400. The attachment 400 is equipped with a corresponding connecting element 410 that is configured as a nose that can be inserted into the groove. The attachment 400 has a plurality of air outlet elements 420 that are bar or tube-shaped. In a wavy hairstyle, the air outlet elements 420 bring hot air deep into the hair. Air can also leave by additional tubes (not visible here) at the foot of the air outlet elements. Typically, there is a distance of several centimeters between the tops of the air outlet elements and their foot parts. First and second sensors can be provided in such a gap. For example, at the foot of the air outlet elements 420 can lie the area 440 of a first sensor. At the end of the air outlet elements 420 can lie the area 442 of a second sensor. Sensors attached there may in turn be, for example, temperature sensors, so that a temperature difference can be measured. However, it is also possible that a moisture difference will be measured. The corresponding data can in turn generate a parameter by means of which the temperature of the hair dryer 300 can be regulated. The parameter can be partially transmitted to the hair treatment device, in this case the hair dryer, by a cable or in a wireless fashion.

Providing two sensors at the precisely described locations, as well as other embodiments of the invention described herein, thus allow us to provide a very convenient, automated and efficient hair-drying process and to offer corresponding devices.

What is claimed is:

1. A portable hair treatment device that is suitable for heating hair and which comprises a heating element that transmits heat to at least one heating surface for contacting hair, wherein during operation, the heating element is heated to a starting temperature, and the temperature of the heating element is regulated by a temperature control, wherein the hair treatment device comprises two temperature sensors positioned on said hair treatment device that measure the temperature of the hair being treated, and the temperature control determines any temperature difference measured by the first and second sensors, and the temperature control automatically regulates the treatment temperature based on the temperature measurements.

2. A hair treatment device according to claim 1 in which the sensors are arranged to be in direct contact with the hair during use of the hair treatment device.

3. A hair treatment device according to claim 1 in which the sensors are arranged to be in indirect contact with the hair during use of the hair treatment device.

4. A hair treatment device according to claim 1 which is a hair dryer.

5. A hair treatment device according to claim 1 which is a curling iron.

6. A hair treatment device according to claim 1 which is a hair straightener.

7. A hair straightener according to claim 6, in which the at least one heating surface has a front area and a rear area relative to the feed-through direction of hair during use of the device, wherein the two temperature sensors comprise a first temperature sensor and a second temperature sensor, and the first temperature sensor is adjacent the front area of the heating surface, and the second temperature sensor is adjacent the rear area of the heating surface.

8. A method for thermal hair treatment using a hair treatment device, said method comprising:

providing a portable hair treatment device comprising: a heating element that transmits heat to a heating surface, said heating surface having a front area and a rear area; said heating element being regulated by a temperature control; a first temperature sensor adjacent the front area of the heating surface; and a second temperature sensor adjacent the rear area of the heating surface; and contacting the hair with the hair treatment device, wherein the temperature sensors measure the temperature of the hair being treated, and the temperature control determines any temperature difference measured by the first and second temperature sensors, and the temperature control automatically regulates the treatment temperature based on the temperature measurements.

9. A method for treating hair according to claim 8, in which the hair treatment device is a hair straightener.

10. A method for thermal hair treatment according to claim 8, wherein the heating element of the hair treatment device is heated to a preset temperature before contacting the hair with the hair treatment device.

11. A method according to claim 8, in which the temperature is increased when a significant difference in temperature between the first temperature sensor and the second temperature sensor is measured.

12. A method according to claim 8, in which the temperature is lowered when a negligible difference in temperature between the first temperature sensor and the second temperature sensor is measured.

13. The hair treatment device of claim 1 wherein the temperature sensors are in contact with said at least one heating surface.

14. The hair treatment device of claim 1 wherein said device has a first surface and an opposing second surface that clamp the hair therebetween, and said temperature sensors comprises a first temperature sensor on said first surface and a second temperature sensor on said second surface.

15. The hair treatment device of claim 1 wherein said heating surface comprises part of a generally U-shaped element having two surfaces and two side legs, wherein the heating surface comprises one surface of the U-shaped element, and the heating element is provided on the surface of the U-shaped element opposite the heating surface, wherein one temperature sensor is provided on one of said side legs, and the other temperature sensor is provided on the other of said side legs.

16. A hair treatment device comprising:

a portable hair dryer comprising a handle, a heating element, and a temperature control, wherein said heating element is regulated by said temperature control, and a hot-air outlet nozzle joined to said handle; and an attachment that is removably connectable to said hair dryer, said attachment having a plurality of air outlet elements, each of said air outlet elements having a foot part and a top spaced away from said foot part, wherein said attachment comprises:

a first temperature sensor joined to said attachment adjacent to the foot of said air outlet elements; and a second temperature sensor joined to said attachment adjacent to the top of said air outlet elements, wherein said temperature sensors measure the temperature of the hair being treated, and the temperature control determines any temperature difference measured by the first and second temperature sensors, and the temperature control automatically regulates the treatment temperature based on the temperature measurements.

* * * * *